US006702045B1

(12) United States Patent
Elsby

(10) Patent No.: US 6,702,045 B1
(45) Date of Patent: Mar. 9, 2004

(54) DRILLING APPARATUS

(75) Inventor: John Elsby, Leeming (AU)

(73) Assignee: Azuko Party Ltd, Kewdale (AU)

( * ) Notice: Subject to any disclaimer, the term of this patent is extended or adjusted under 35 U.S.C. 154(b) by 0 days.

(21) Appl. No.: 10/088,824

(22) PCT Filed: Sep. 22, 2000

(86) PCT No.: PCT/AU00/01179

§ 371 (c)(1),
(2), (4) Date: May 31, 2002

(87) PCT Pub. No.: WO01/21930

PCT Pub. Date: Mar. 29, 2001

(30) Foreign Application Priority Data

Sep. 22, 1999 (AU) ..... PQ 3025

(51) Int. Cl.[7] ..... E21B 4/00

(52) U.S. Cl. ..... 175/93; 175/296; 175/100; 175/415; 175/402; 175/417; 175/171; 175/189; 173/17; 173/135

(58) Field of Search ..... 175/93, 100, 171, 175/189, 293, 296, 320, 414, 415, 402, 417; 173/16, 17, 131, 135

(56) References Cited

U.S. PATENT DOCUMENTS

| | | | | |
|---|---|---|---|---|
| 5,366,032 | A | | 11/1994 | Kay |
| 5,566,771 | A | * | 10/1996 | Wolfer et al. |
| 5,957,226 | A | * | 9/1999 | Holte |
| 5,975,222 | A | * | 11/1999 | Holte |
| 6,035,953 | A | * | 3/2000 | Rear |
| 6,182,776 | B1 | * | 2/2001 | Asberg |

FOREIGN PATENT DOCUMENTS

| | | |
|---|---|---|
| DE | 285 694 | 3/1991 |
| EP | 0 197 019 A1 | 10/1986 |
| EP | 0 322 347 A1 | 6/1989 |
| RU | 1696687 A1 | 12/1991 |

* cited by examiner

*Primary Examiner*—Roger Schoeppel
(74) *Attorney, Agent, or Firm*—Fulbright & Jaworski L.L.P.

(57) ABSTRACT

There is provided drilling apparatus (10) comprising a hammer casing (11), a free piston motor piston guide and porting sleeve (12), a drive sub (13), a drill bit (15) splined by shank (16) to the drive sub (13). Below the splined portion (17) the drive sub is relieved at (23) to form an annular air space for motor exhaust air from the splines (16) and (17). The drive sub (13) retains a gauge sleeve (24) via an annular flange (25) between the hammer casing (11) at (26) and a shoulder (27) on the drive sub (13). Below the shoulder (27) the outer diameter of the drive sub (13) is provided with eight grooves that form conduits (30) with the lower portion (31) of the gauge sleeve (24) extending parallel to the drill axis in communication with the space (23) via ports (32). The lower portion (31) extends down the side of the drive sub (13) and terminates with it at (34) adjacent the shoulder (33) at the transition from the bit shank (16) and the bit head (35). The bit head (35) is provided with eight channels (36) in register with respective ones of the conduits (30) and which extend straight down and through the cutting face (37) of the bit head (35). The cutting face (37) is provided with collection openings (42). Channels (36) communicate with a pair of offset grooves (44) to facilitate flushing of the bit face. The remaining channels (36) provide for more general air flow across the cutting face (37) of the bit bead (35).

24 Claims, 13 Drawing Sheets

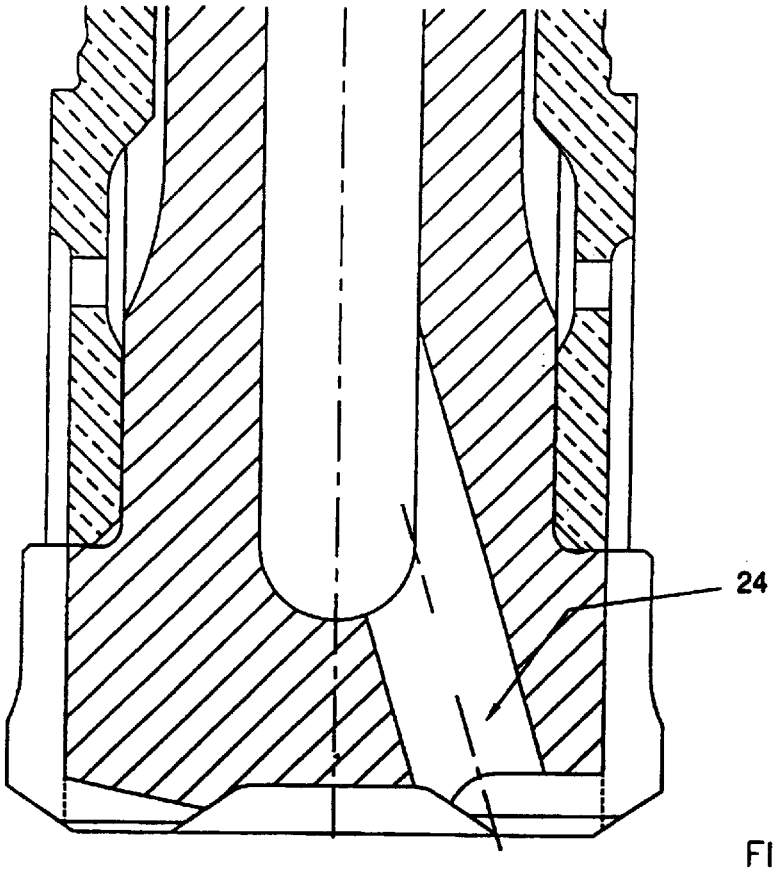
FIG. 4
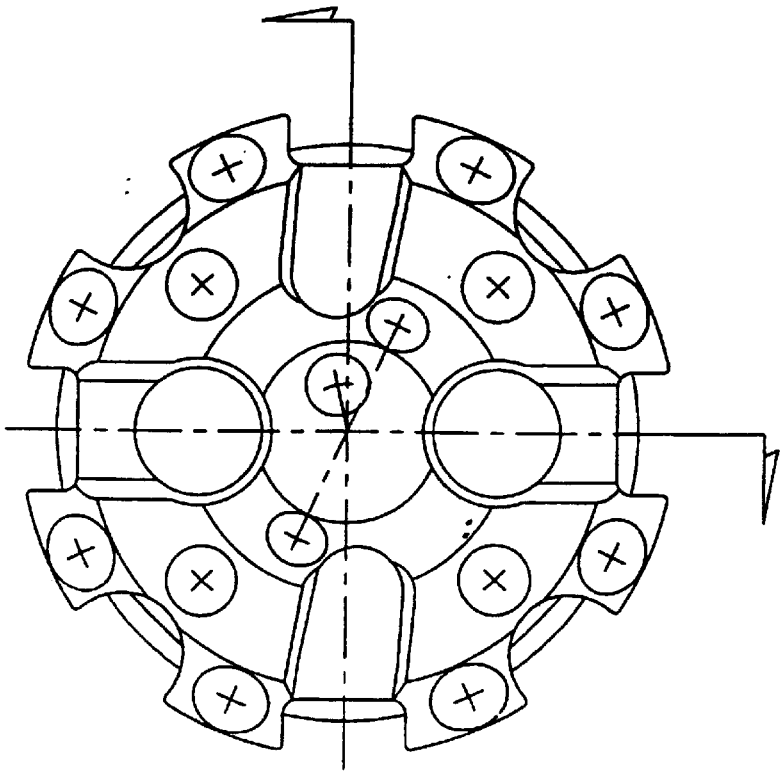

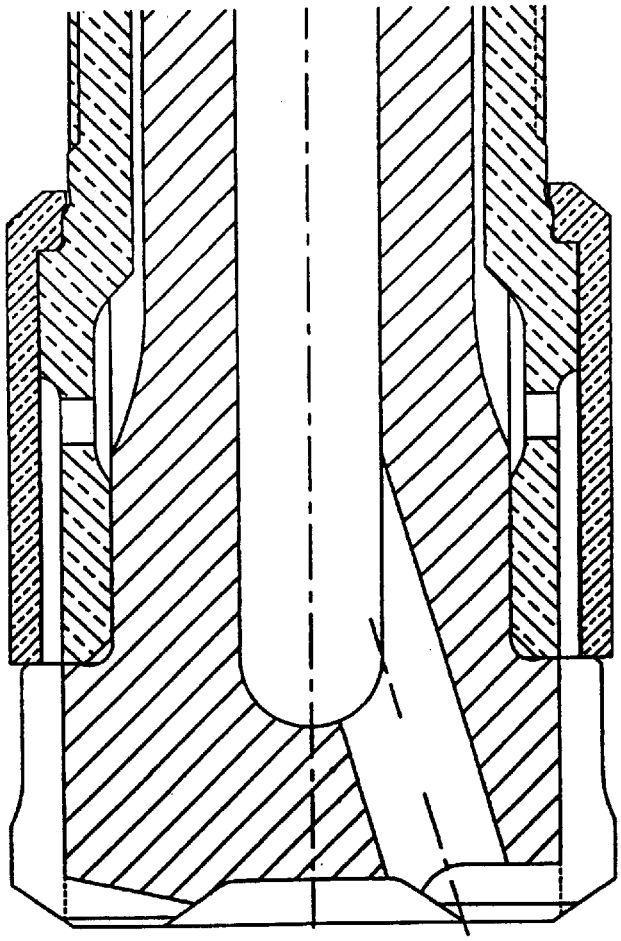
FIG. 5
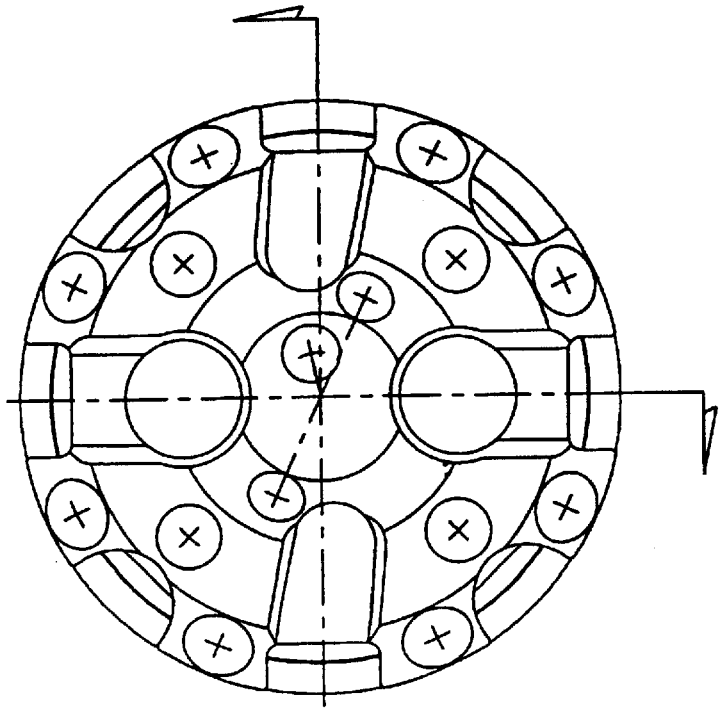

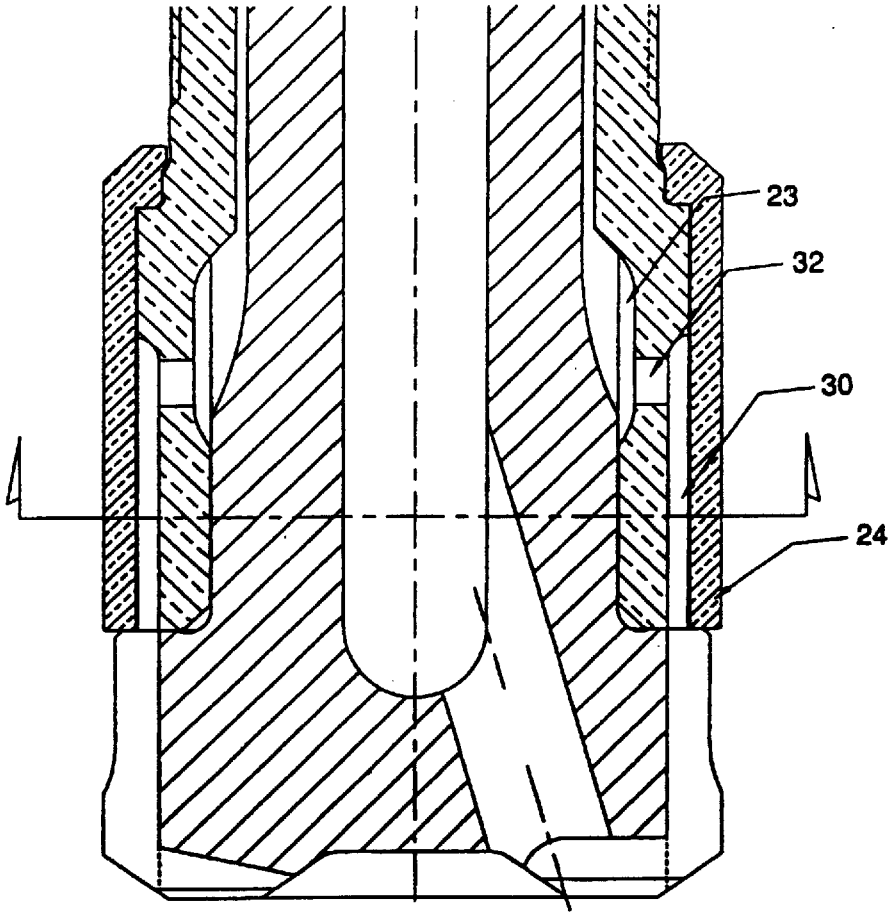
FIG. 6
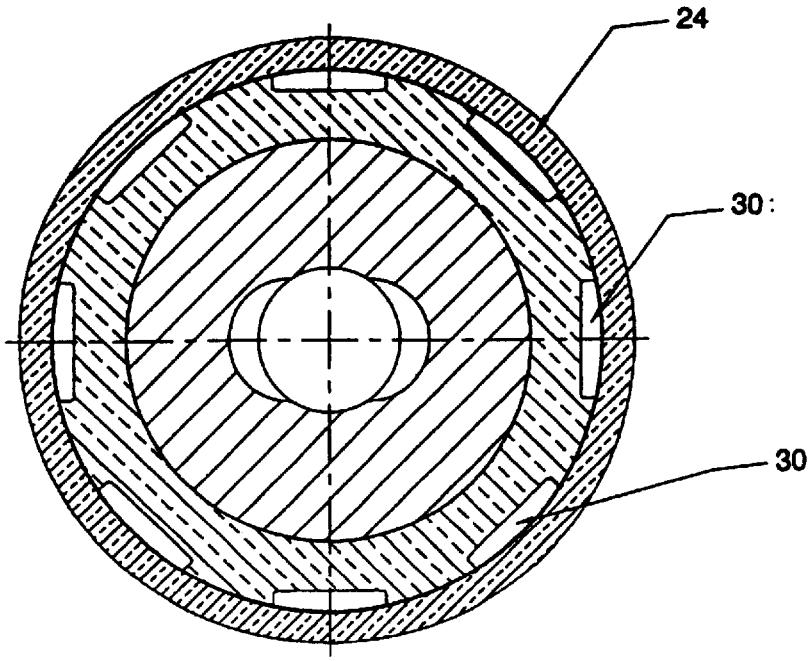

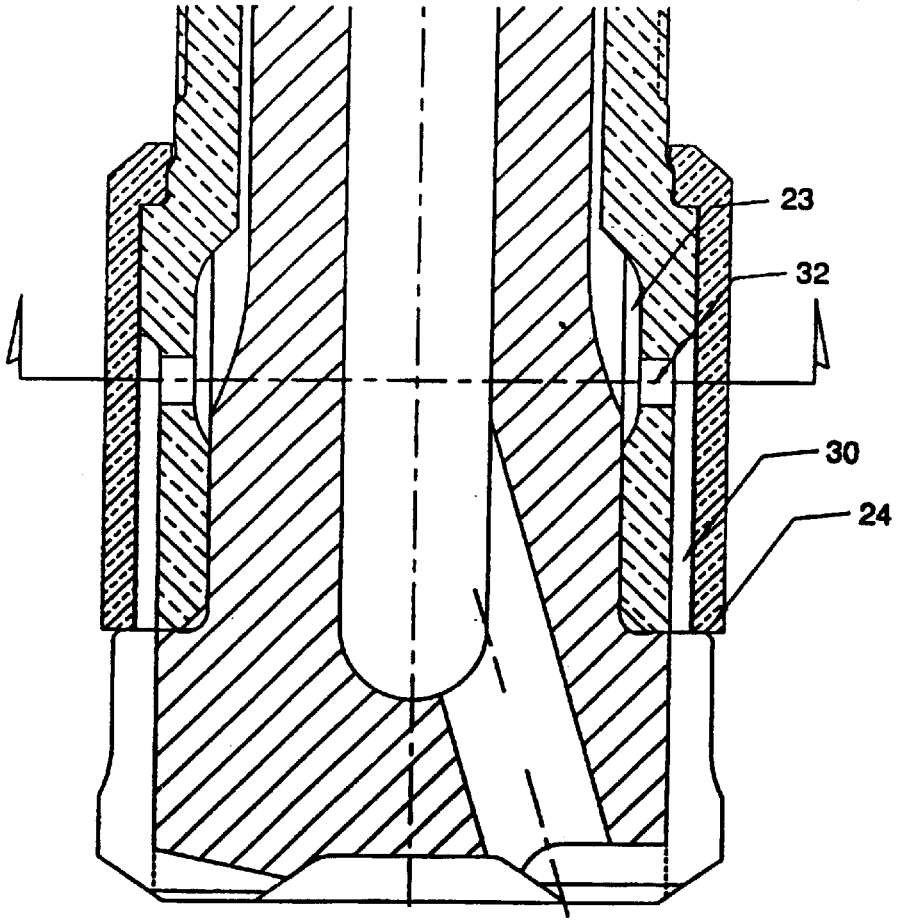
FIG. 7
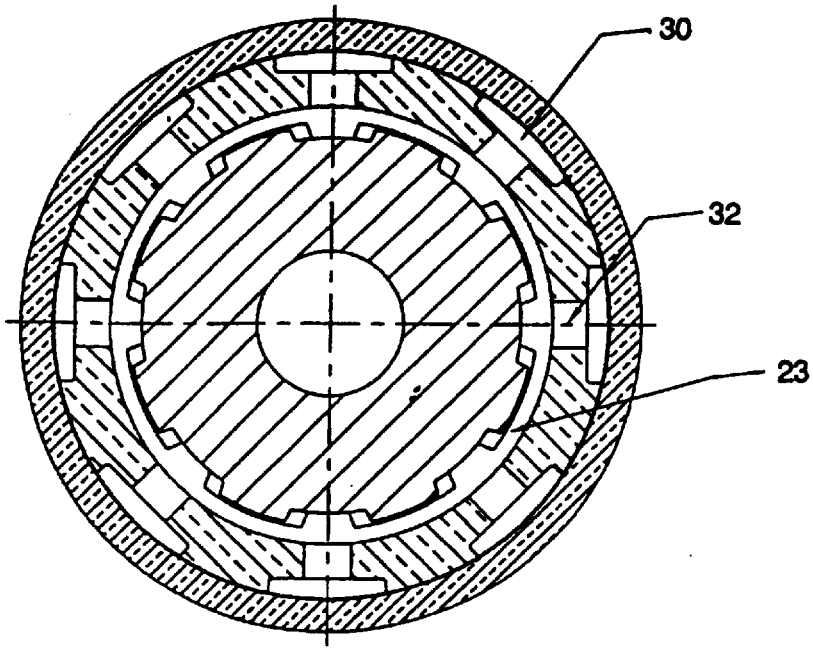

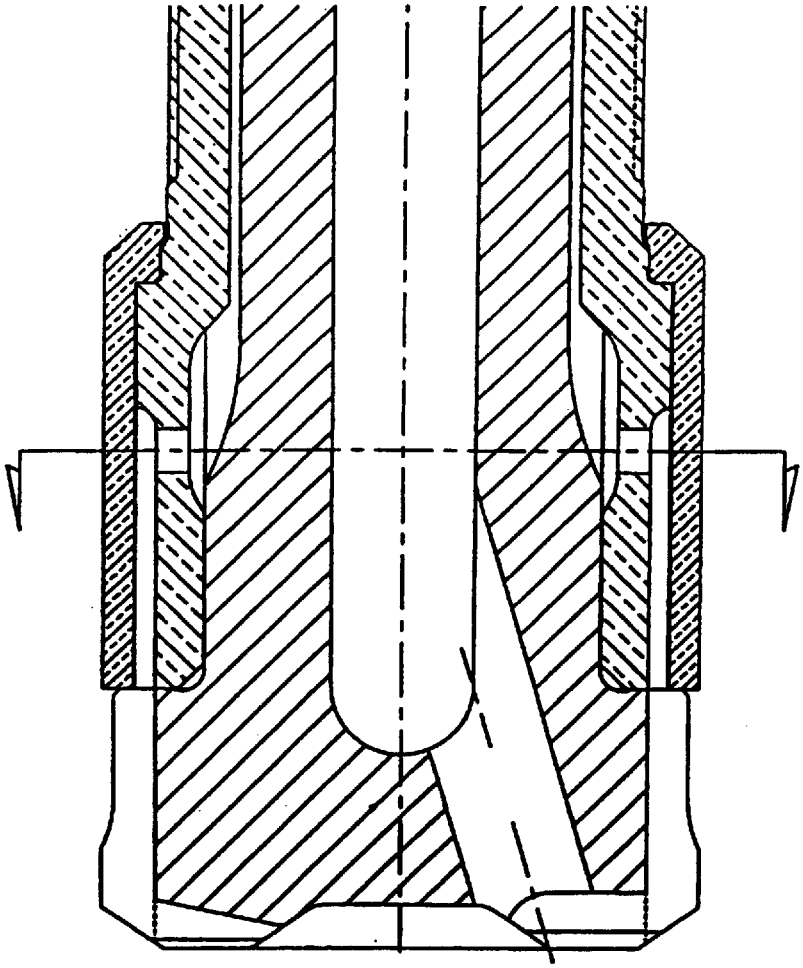
FIG. 8
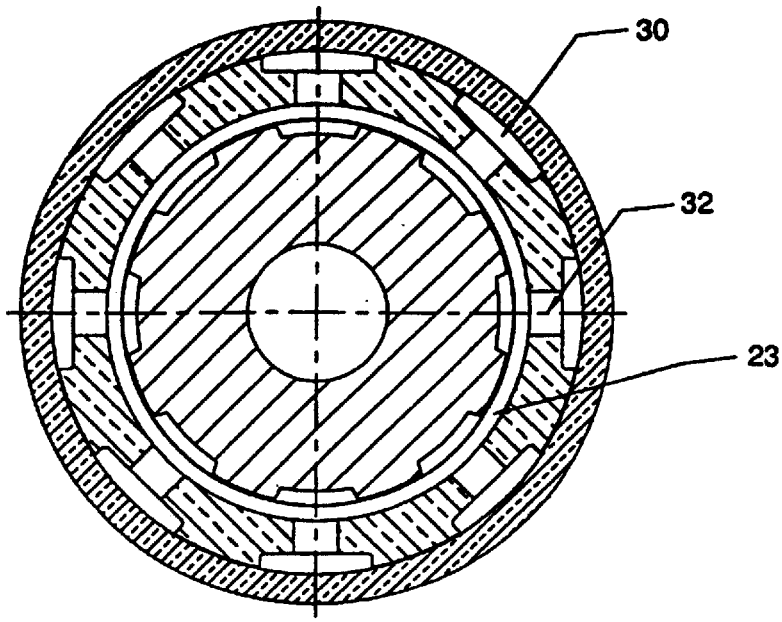

DRILLING APPARATUS

This invention has particular application to a reverse circulation down hole face sampling hammer, and for illustrative purposes reference will be made to this application. However, it is envisaged that this invention may find application in other forms of drilling apparatus such as blasthole hammers, tricone RC drills and crossover sub RC hammers.

In the operation of sampling hammers it is understood that sampling integrity is improved if the hammer exhaust air used to flush cuttings is directed towards the cutting face of the bit. By this means chips are entrained at the point of their production. In Australian Patent Numbers 638571 and 656724, there are disclosed face sampling reverse circulation downhole hammers including a shroud or sleeve that extends beyond the lower end of the chuck or drive sub to surround the head of the bit, which is relieved to accommodate the sleeve or shroud.

The shroud or sleeve cooperates with air passages down the side of the bit head to direct air toward the cutting face of the bit. Air exhausted from the hammer free-piston motor passes down the splines that engage the bit for rotation and reciprocation in the chuck or drive sub. Air exits the lower end of the shroud or sleeve throught the air passages in the side of the bit head, to pass substantially to and across the cutting face of the bit.

Chippings are entrained in the air stream and conducted to the surface through sample apertures in the bit cutting face communicating with a sample recovery conduit comprising an axial passage defined through the hammer to the inner tube of a dual wall drill string.

The shroud or sleeve is selected to be of substantially the same diameter as the gauge row of carbides of the bit head, and of greater diameter than the hammer casing, in order to provide a partial seal between the borehole and the hammer to constrain air to the cutting face of the bit and to thus substantially reduce both blowby of exhaust air and contamination of the sample from above.

The prior art hammers described above rely on the bit head itself to provide one wall of the conduits or passages conveying air towards the cutting face of the bit. The bit must necessarily run at a clearance from the sleeve, and the bit head necessarily oscillates relative to the sleeve. As a result of this, combined with the fact that the shroud or sleeve must stop well short of the cutting face to allow sufficient bit head metal to remain to support the gauge row, the air exiting the passages is not fully directed downward towards the cutting face through the grooves in the bit head exclusively. The exiting air also describes an outwardly expanding path from the passages, to be constrained by the borehole and turned across the cutting face of the bit. In tests it has been determined that the divergence from the vertical direction of the air flow is between 30 to 40° included angle.

The present applicant is the developer of an alternative RC hammer. In this embodiment, an extended lower bearing surface on the bit shank cooperates with a bore in the lower end of the drive sub. The bore is relieved with four lenticular section cut-outs to provide for egress of exhaust air, the cut-outs being indexed to respective grooves down the side of the bit head. The bit head is shortened to bring the egress point closer to the face of the bit. This embodiment may be termed a sleeved sub/short bit head type. Again, the bearing surface oscillates relative to the bore and the cut-outs well short of the cutting face to allow sufficient bit head metal to remain to support the gauge row. Accordingly, the air exiting the passages is not fully directed downward towards the cutting face through the grooves in the bit head exclusively.

The exiting air also describes an outwardly expanding path from the passages, to be constrained by the borehole and turned across the cutting face of the bit. Yet further, the cut-out positions are necessarily closer to the axis than the shrouded bit head passages described in Australian Patent Numbers 638571 and 656724. Accordingly, the bit head passages in the present applicant's prior art hammer must direct the air outward of the axis to a degree, thus exacerbating the outward component of direction of the expanding exhaust air. In fact, in tests it has been determined that the divergence of a component of the air flow is close to 180° included angle in this embodiment, or at right angles to the drilling direction. This observation is borne out in practice, where this apparatus performs less effectively in soft or broken ground than the commercial embodiment of Australian Patent Number 638571 in that the walls of the borehole are eroded by the divergent component.

At least part of this tendency arises since the air is directed between the shank of the drill bit and the minor bore of the drive sub. Thus there is a major change in diameter requiring an outward component of direction of air flow. Typically, the section changes from about 88 mm at the shank to 140 mm at the bit head.

In soft ground, the turbulence and expansion of air exhausted from prior art hammers tends to scour the borehole such that the hole is significantly larger than the gauge sleeve. This in turn causes loss of seal resulting in loss of sample up the borehole. As air velocity up the sample recovery conduit is lost through blowing by the seal, there is an increased tendency of the conduit to block, particularly at the sample return holes in the drill bit.

In one aspect the present invention relates to drilling apparatus including:

- a chuck;
- a drill bit supported in said chuck and having a bit head extending below said chuck, said bit head having at least one substantially longitudinal air channel defined down the outside of the bit and extending through the cutting face thereof;
- a gauge sleeve secured in relation to said chuck; and
- at least one air passage defined between said gauge sleeve and said chuck having a terminal portion extending substantially parallel to the axis of the drill bit and substantially in register with said air channel.

The drilling apparatus may be selected from any suitable apparatus commonly used for reverse circulation drilling. For example the drilling apparatus may comprise a tricone reverse circualtion arrangement or a down-the-hole (DTH) hammer. It is envisaged that this invention will find its best application in respect of face sampling DTH hammers and for illustrative purposes the invention will be further described with reference to this application. Further the invention will be described with reference to those hammers of the type having a pair of sample recovery ports through the cutting face of the bit communicating with respective ones of a pair of siamesed sample ducts, whereby chips and exhaust air are conveyed to a sample recovery path extending up through the hammer to the inner tube of the drill string and thence to the surface.

The chuck may be of any suitable form. For example, the chuck may comprise the type associated in the DTH hammer art as a drive sub, or alternatively may comprise the variant known as a SAMPLEX chuck. The chuck may be secured to the hammer casing by any suitable means. Typically the chuck or drive sub is threadably engaged with the hammer casing.

The chuck or drive sub may mount the drill bit in any known manner in the art. Typically the drill bit comprises a splined shank portion which is adapted to mounted in sliding relation to a correspondingly splined portion of the chuck or drive sub. Alternatively, the drill bit and drive sub may be engaged with drive pins and cooperating slots or any other suitable means.

The gauge sleeve may be secured in relation to the chuck by any suitable means. For example, the gauge sleeve may be secured to the chuck or hammer casing by threads. However it is preferred that the gauge sleeve be retained by means of an annular flange whereby the chuck in engaging the hammer casing thereby secured the gauge sleeve in position. If desired the gauge sleeve may be further located against rotation by the provision of keys or pins adapted to locate the gauge sleeve relative to the chuck or hammer casing. The keys or pins may be associated with the annular flange.

The at least one air passage defined between the gauge sleeve and the chuck may comprise an annular space. For example, the gauge sleeve may be secured by an annular flange as described above and be adapted to conform closely to the chuck at the upper portion thereof and be radially clear of the chuck therebelow. By this means the sleeve forms a substantially bell-like cover for the lower end of the chuck, resulting in a narrow annular space opening downward towards the bit head.

Alternatively, the at least one air passage defined between the gauge sleeve and the chuck may comprise at least one conduit formed in one or both of the gauge sleeve and the chuck. For example, the chuck may be provided with at least one longitudinal milling on its outer surface, the open face of the milling being closed by the sleeve in use to form a conduit.

The air passage may be supplied with flushing air by any suitable means. For example, the air passage may be provided with supply air conveyed from the air supply side of the free piston hammer. Alternatively, the air passage may be supplied with exhaust air from the free piston hammer.

There may be provided a plurality of air passages, each supplied with exhaust air from the free piston hammer. In such cases the air flow efficiency may be maximised by provision of corresponding conduits from the respective spline passages to the air passages. For example, there may be provided a number of air passages equal to or a product of the number of splines, wherein ports through the chuck provide communication between the spline and the respective air passage. If desired, local air pressure and velocity variations at the splines may be alleviated by manifolding the air supply in the region of the splines, whereby the ports convey the air from the manifold to the air passages.

The air passages preferably exit the chuck and sleeve assembly at terminal portions that are coterminous with the lower ends of the chuck and sleeve and configured to ensure that the air direction remains parallel to the drill assembly axis. If desired the gauge sleeve may extend beyond the lower end of the drive sub to cover part of the bit head, whereby the gauge sleeve shrouds a portion of the bit head channels below the air passages thereby further constraining the flow of air towards the cutting face of the bit.

The channels in the side of the bit head preferably remain substantially parallel to the axis of the drill assembly through to the cutting face of the bit. There are preferably as many channels as there are conduits. The channels may be open sided. Alternatively, the channels may be partially or fully closed to the sides. The cross sectional area of the channels is preferably at least as large as the cross sectional area of the exit of the air passages.

In examples having a plurality of air passages corresponding to a plurality of channels, these may be substantially identical. Alternatively one or more of the channels may be configured to perform different functions. Accordingly there may be provided channels of section selected to provide direct flushing air preferentially to the face of the bit adjacent the sample recovery holes. There may be provided other channels adapted to provide flushing air preferentially and tangentially across the central portion of the cutting face of the bit that may otherwise become a static dead space.

In order that this invention may be more readily understood and put into practical effect, reference will now be made to the accompanying drawings which illustrate a preferred embodiment of the invention and wherein:

FIG. 4 is a three-quarter vertical section through the bit head of FIG. 3 and drive sub in assembly;

FIG. 5 is a three-quarter vertical section through the bit head and drive sub of FIG. 4 showing gauge sleeve installation;

FIG. 6 is a bottom plan section through the bit shank, drive sub and sleeve of the apparatus of FIG. 5;

FIG. 7 is a further bottom plan section through the bit shank, drive sub and sleeve of the apparatus of FIG. 5;

FIG. 8 is a top plan section through the bit shank, drive sub and sleeve of the apparatus of FIG. 5;

Figure 1:
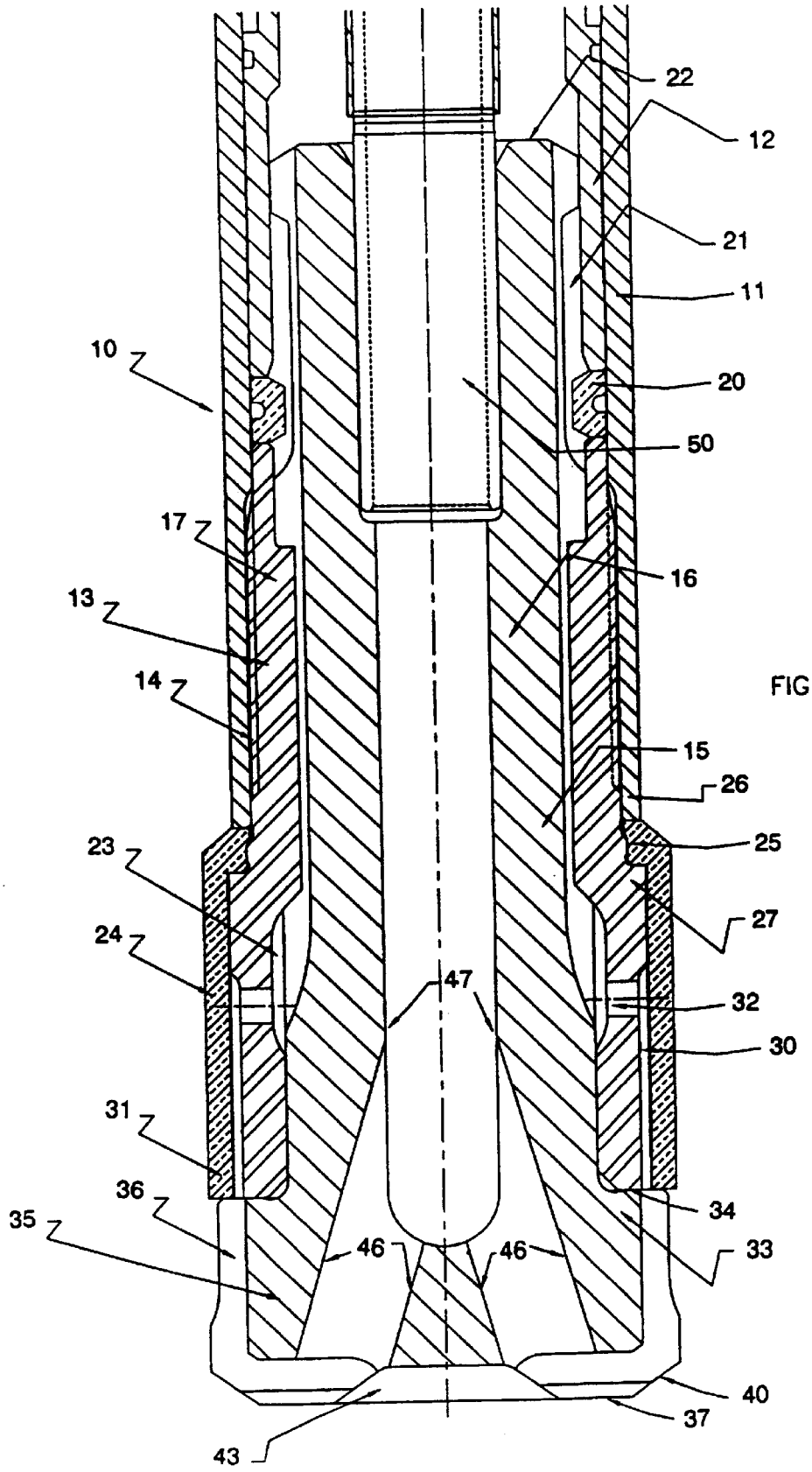
FIG. 1 is a vertical section through typical apparatus in accordance with the present invention.

In FIG. 1 there is illustrated drilling apparatus generally indicated as 10 comprising a hammer casing 11 within which is mounted a conventional free piston motor of which the piston guide and porting sleeve 12 is shown. A drive sub or chuck 13 is engaged with the hammer casing by threads at 14. A drill bit 15 comprises a splined shank 16 and is mounted in the chuck 13 at splined portion 17 thereof. The bit shank 16 is retained in the chuck 13 by means of a bit retaining ring 20 secured in position between the chuck 13 and the porting sleeve 12. Axial movement of the bit shank 16 is permitted by provision of an undercut 21 accommodating the bit retaining ring 20 below the anvil 22 portion of the bit shank 16.

Below the splined portion 17 of the chuck 13 the inner bore of the chuck is relieved at 23 to form an annular air space adapted to receive exhaust air from the free piston motor via the splines formed by 16 and 17.

The chuck 13 retains a gauge sleeve 24 by compressive engagement of an annular flange 25 between the end of the hammer casing 11 at 26 and a shoulder 27 machined on the chuck 13. Below the shoulder 27 the outer diameter of the chuck 13 is milled to form eight evenly spaced grooves that form conduits 30 with the lower portion 31 of the gauge sleeve 24. Each conduit 30 extends downward substantially parallel to the drill axis and is in fluid communication with the annular space 23 via cross-drilled ports 32.

The lower portion 31 of the gauge sleeve extends down the side of the chuck 13 and terminates with it at 34 adjacent the shoulder 33 at the transition from the bit shank 16 and the bit head 35. The bit head 35 is provided with eight channels 36 in register with respective ones of the conduits 30 and which extend straight down and through the cutting face 37 of the bit head 35. The bit head 35 is configured with a gauge row mounting portion 40 forming the outer periphery of the cutting face 37. Gauge row carbide inserts 41, omitted for clarity in FIG. 1 and illustrated in FIGS. 2 to 5, are disposed in the gauge row mounting portion 40 between the channels 36.

The cutting face 37 is provided with a pair of collection openings 42 associated with an opposed pair of said channels 36, the collection openings being disposed symmetrically about a central depression 43 in the cutting face 37. A further pair of the channels 36 communicate with a pair of offset grooves 44 to facilitate flushing of the bit face. The remaining channels 36 provide for more general air flow across the cutting face 37 of the bit head 35.

Figure 2:
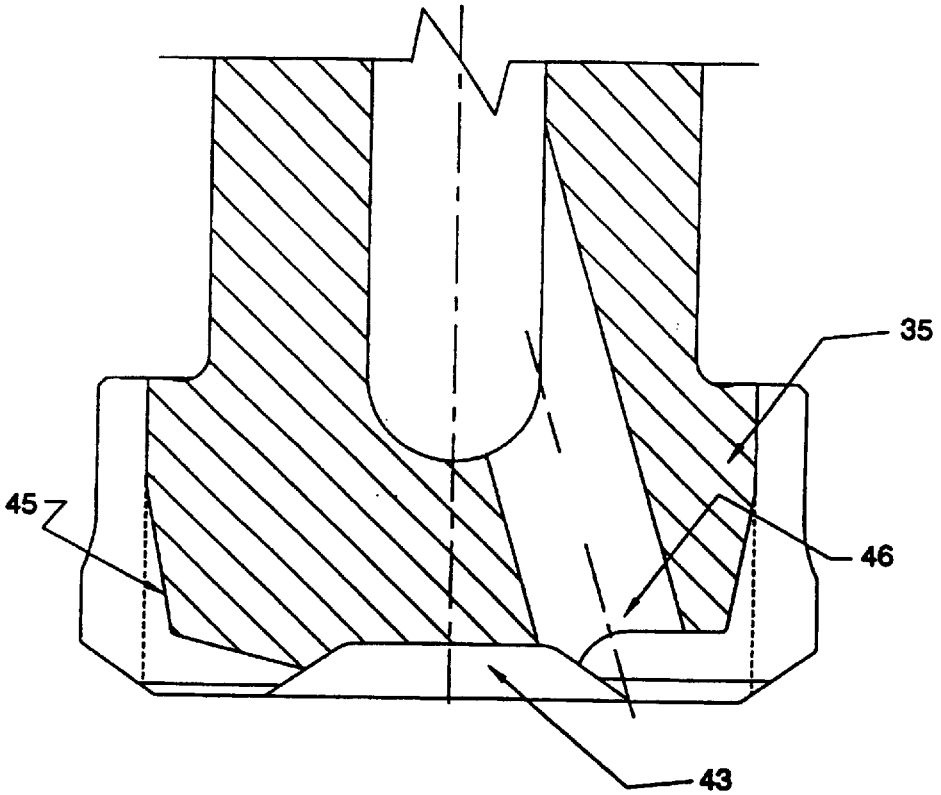
FIG. 2 is a three-quarter vertical section through a bit head suitable for use in conjunction with the apparatus of FIG. 1.
Figure 2:
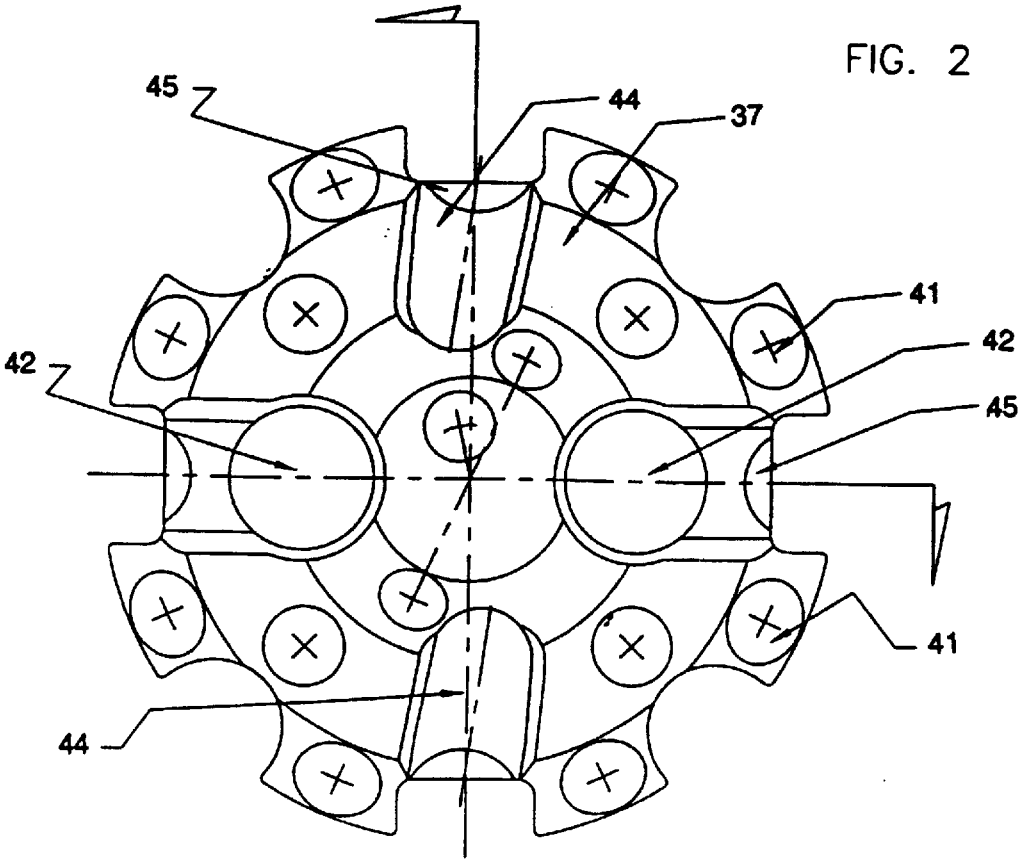
Figure 3:
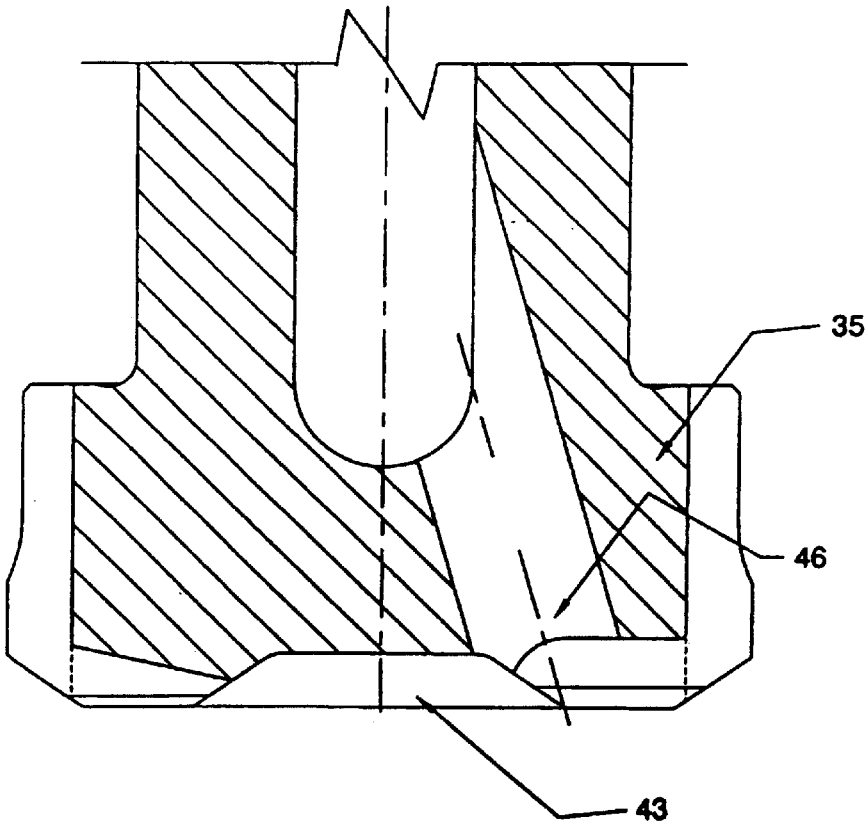
FIG. 3 is a three-quarter vertical section through an alternative bit head suitable for use in conjunction with the apparatus of FIG. 1.
Figure 3:
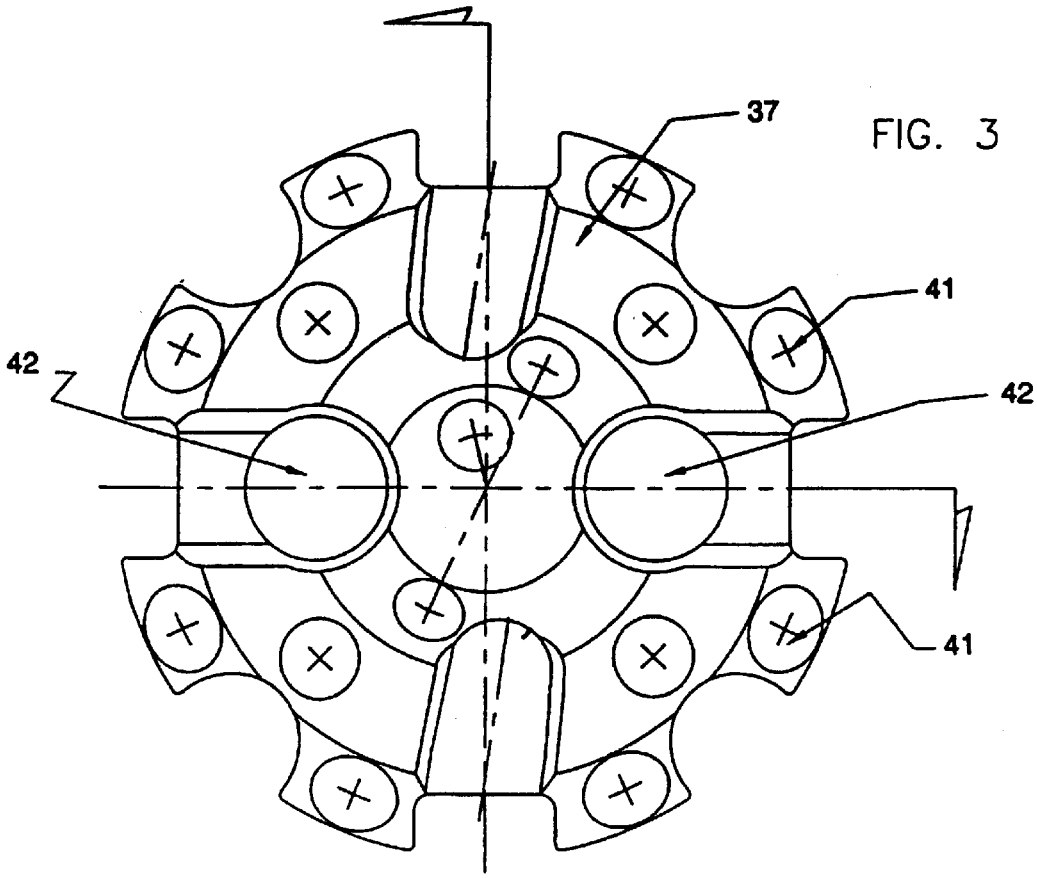

In the embodiment of a bit head 35 illustrated in FIG. 2, there is provided a relieved portion 45 at the bottom of the channels 36 associated with the collection openings 42 and the offset grooves 44, in order to further promote flow therethrough. This relief is dispensed with in the embodiment of FIG. 3.

The collection openings 42 communicate with collection ducts 46, which merge to form an axial collection passage 47 extending up through the bit shank 16. The bore of the collection passage 47 is relieved at its upper end to receive in sliding engagement a sample tube 50 which in turn similarly engages an axial sample recovery bore in the piston of the hammer. By this means a continuous path is maintained whereby the return air and entrained sample are returned to the surface through the inner bore of a dual wall drill string.

Apparatus in accordance with the foregoing embodiments exhibits air flows substantially parallel to the drill axis and thus reduce the amount of borehole scouring compared to prior art apparatus. Insofar as the air will natually tend to diverge with expansion, the configuration of the preferred embodiment as described appears to exhibit a degree of focussing of the air flow towards an imaginary point of the drill axis ahead of the cutting face of the bit. The seal provided by the gauge sleeve is accordingly maintained for longer. The return air is therefore encouraged to return by the easiest path, that is, through the sample collection ducts in the drill bit and thence to the sample recovery tube. In drilling clays and loose geological strata, the air assists in keeping the bit face clear, thus reducing the tendency to regrind cut material and thus reducing bit cutting edge wear. In very soft ground the parallel air flow itself assists in cutting the borehole substantially to gauge.

Figure 9:
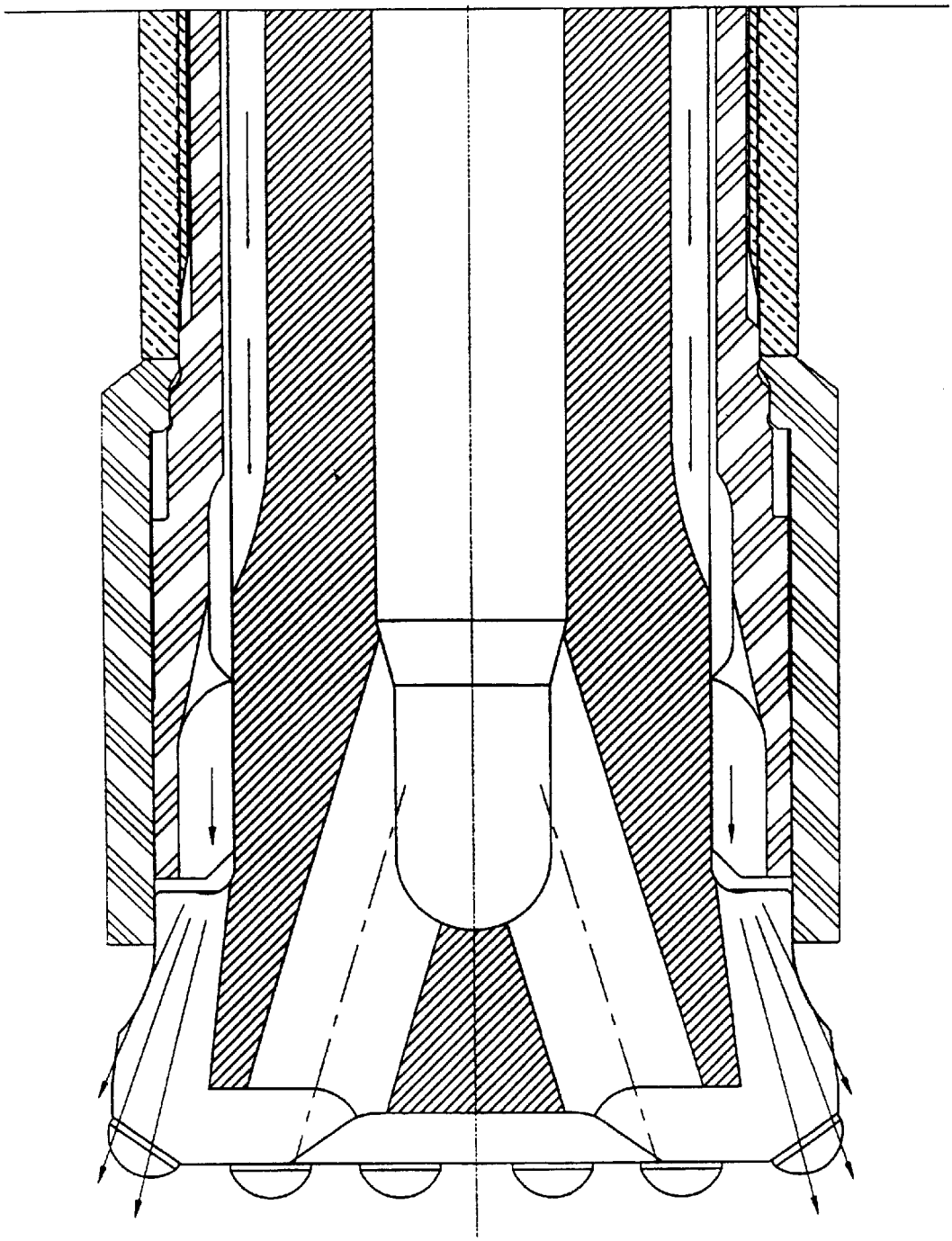
FIG. 9 is taken from a high-speed photograph of airflow from a comparative apparatus to that in accordance with the present invention.
Figure 10:
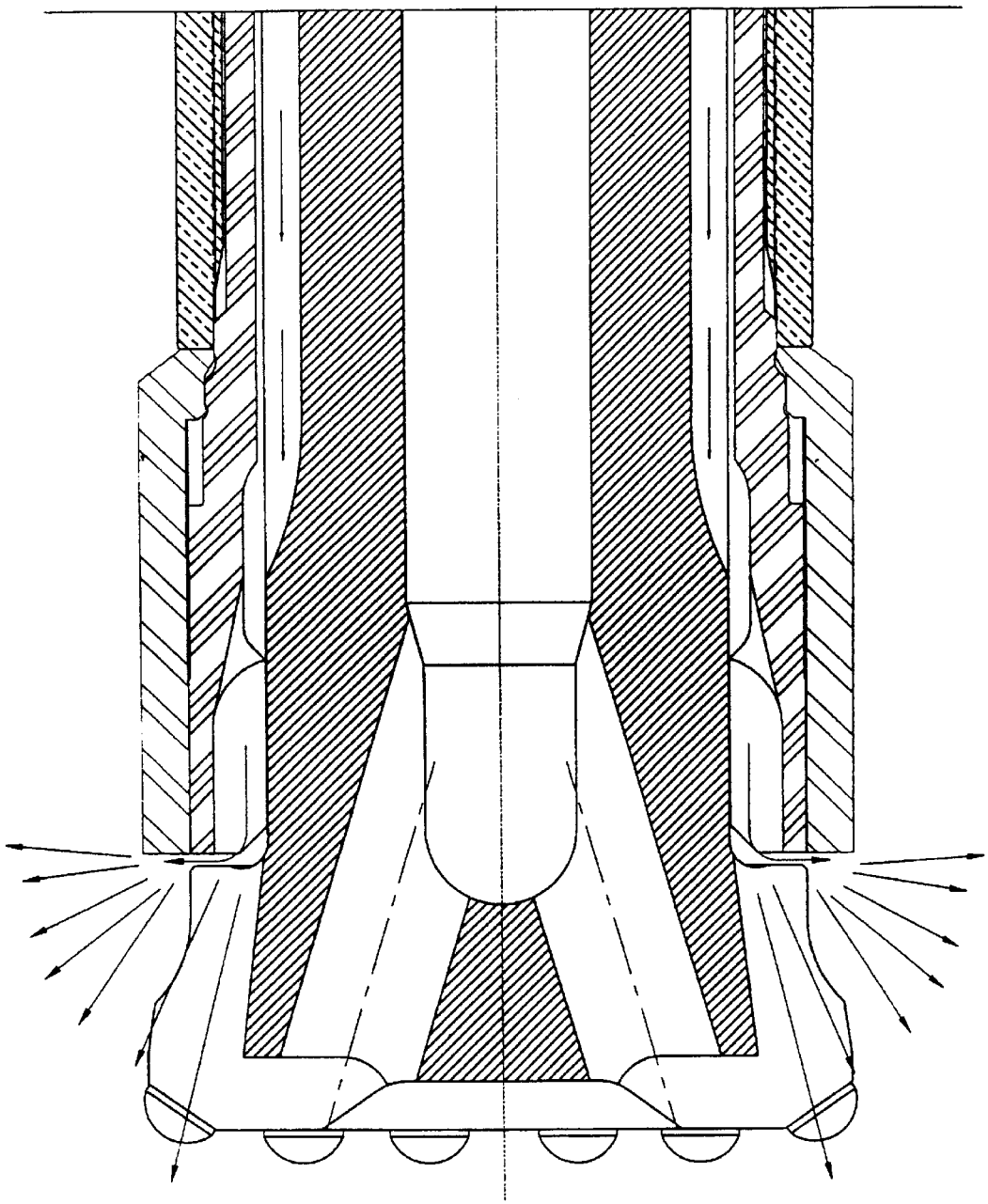
FIG. 10 is taken from a high-speed photograph of airflow from a comparative apparatus to that in accordance with the present invention.
Figure 11:
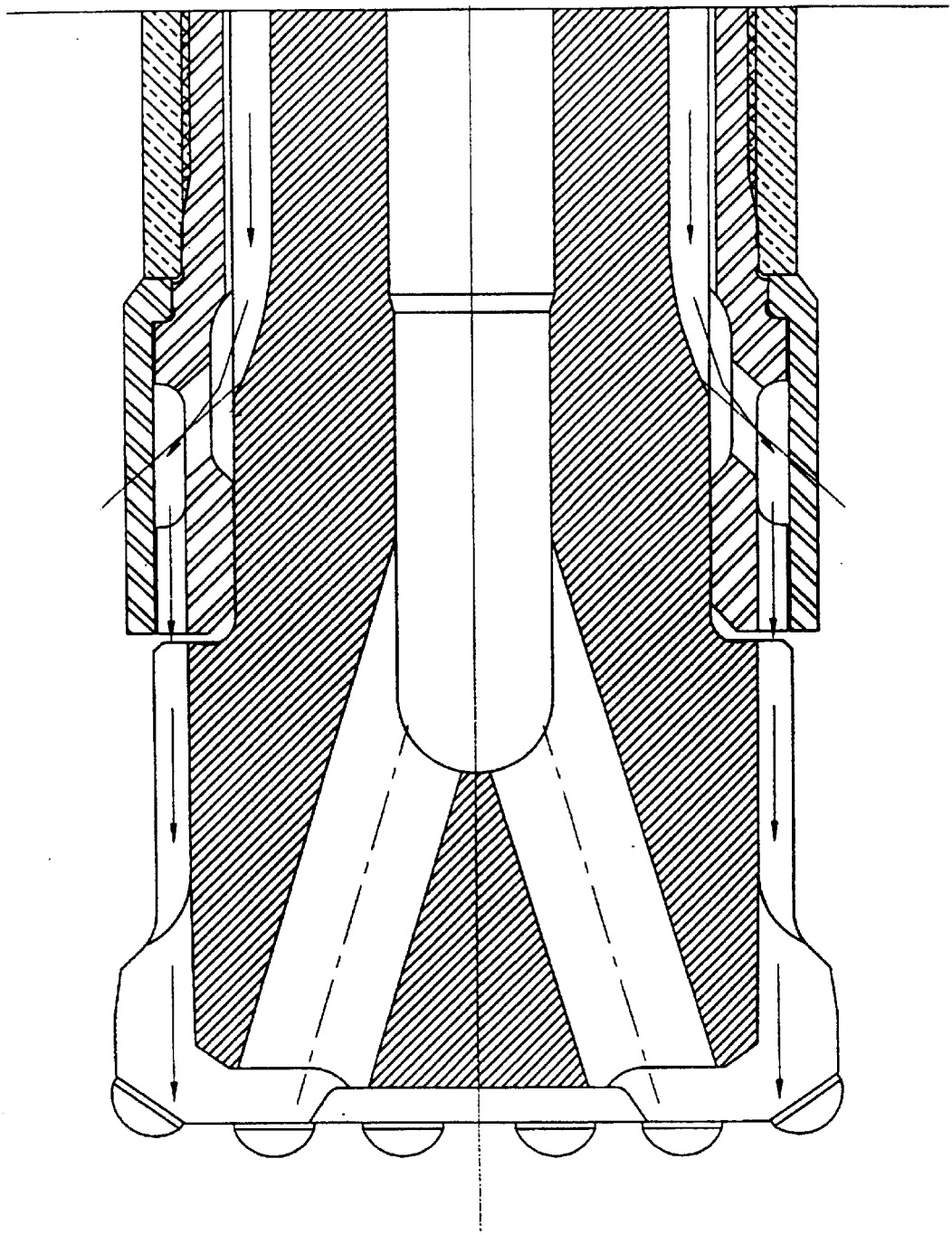
FIG. 11 is taken from a high-speed photograph of airflow from an apparatus in accordance with the present invention.
Figure 12:
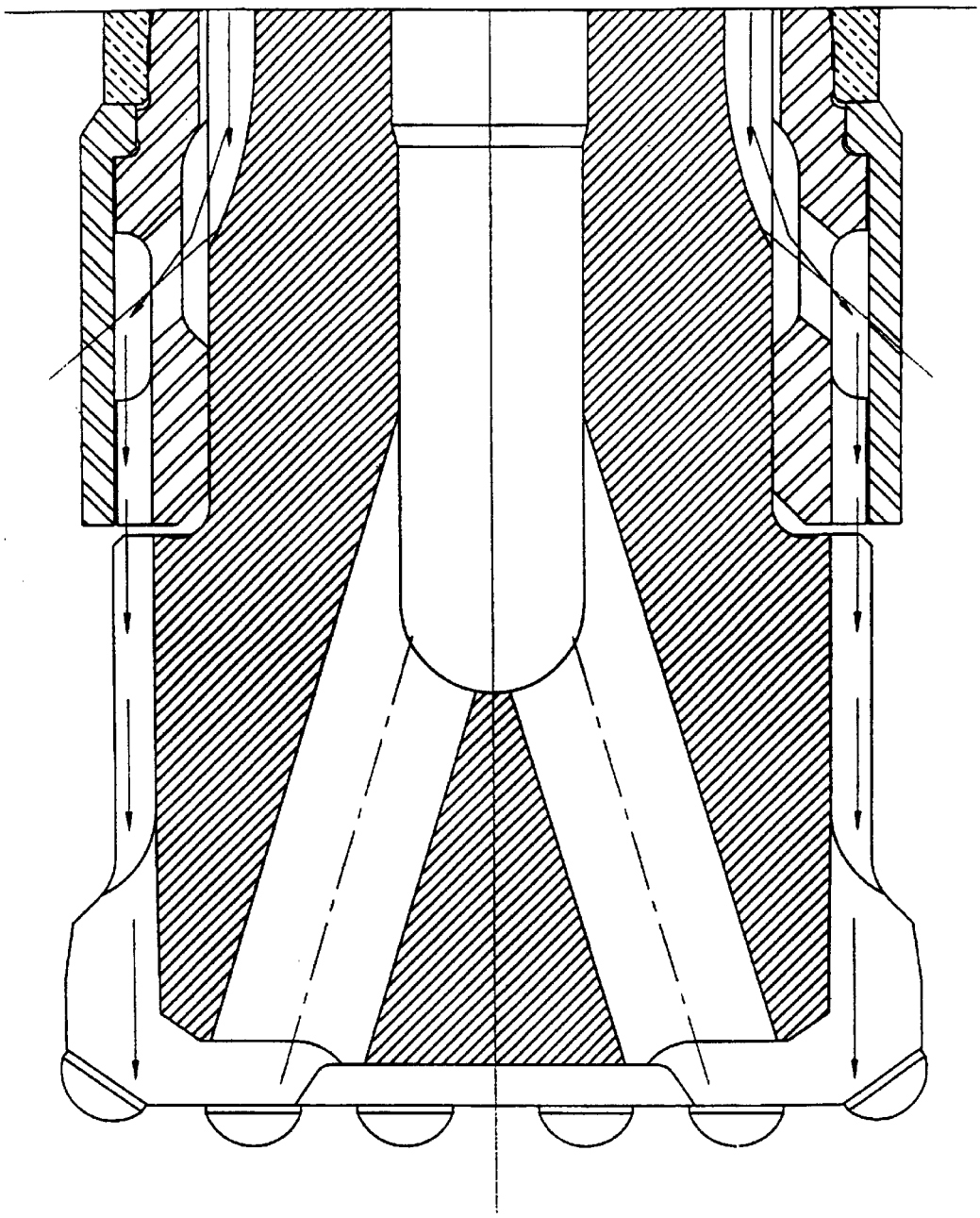
FIG. 12 is taken from a closer high-speed photograph of airflow from an apparatus in accordance with FIG. 11.
Figure 13:
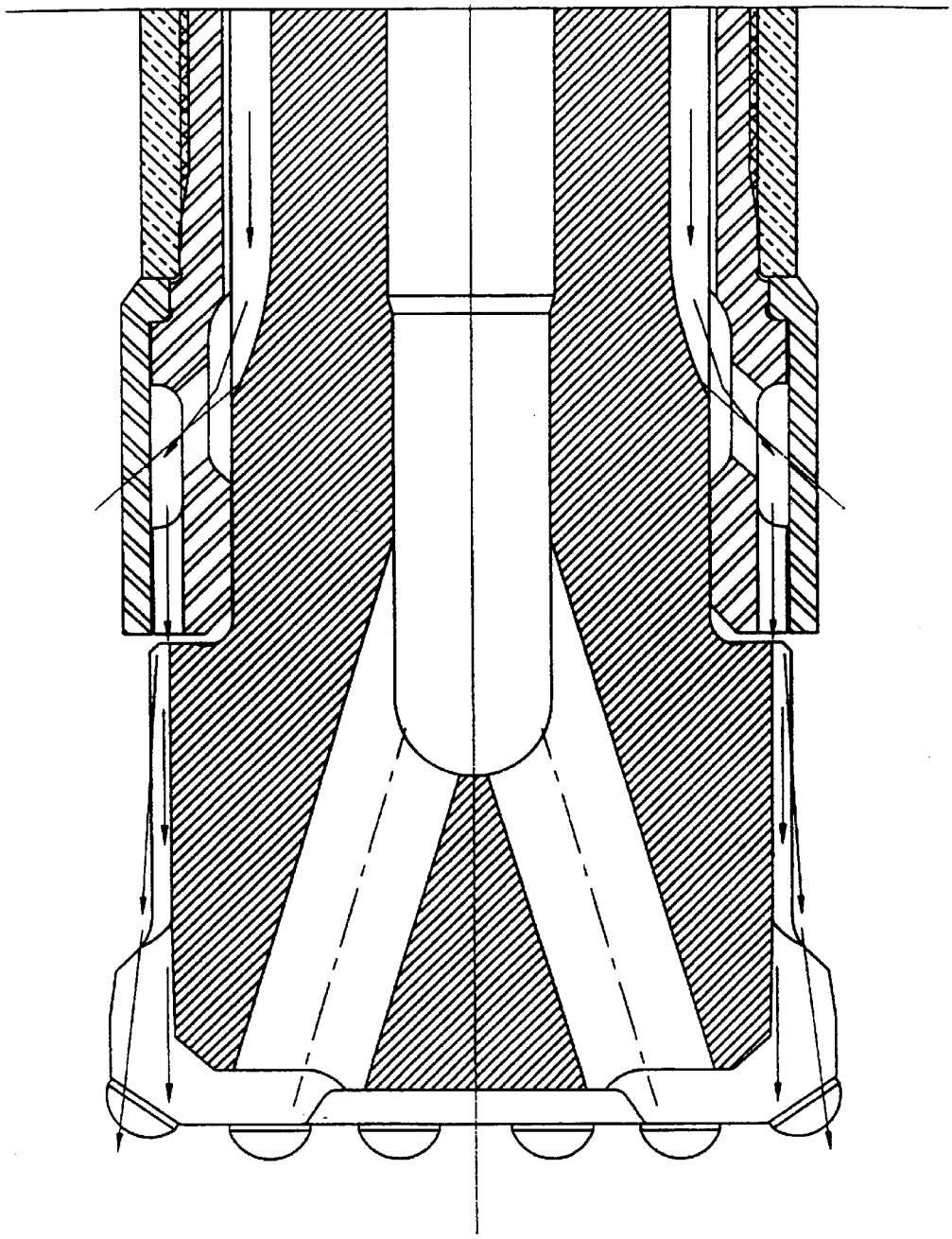
FIG. 13 is taken from a high-speed photograph of airflow from an alternate apparatus in accordance with the present invention.

In order to visualize the actual operation of the foregoing embodiment, there was established a test regime whereby airflow at the fully reaching position was captured by entraining soapy water in the air flow and photographing the air flow with high speed photography. In the test of FIG. 9 there is illustrated a shrouded hammer of the type described in Australian Patent Numbers 638571 and 656724. This shot clearly indicates the included angle of the air flow. In the test of FIG. 10 there is illustrated a sleeved sub/short bit head type, again clearly indicating the air flowing at an included angle of 180°. FIGS. 11, 12 and 13 illustrate the air flows achieved by apparatus in accordance with the foregoing embodiments of the present invention. In all examples the air flow at the reaching position, which is the position at which maximum scouring is expected with the prior art aparatus in broken ground, remains parallel to the drill axis. In the embodiment of FIG. 13, there is some minor divergence since in this embodiment the channels in the bit head were made particularly shallow thus requiring the air to diverge on expansion. Otherwise the embodiments in accordance with FIGS. 1 to 8 perform in accordance with the test results of FIGS. 11 and 12.

It will of course be realized that while the above has been given by way of illustrative example of this invention, all such and other modifications and variations thereto as would be apparent to persons skilled in the art are deemed to fall within the broad scope and ambit of this invention as defined in the claims appended hereto.

What is claimed is:

1. Drilling apparatus including:

a chuck supported in a casing:

a drill bit supported in said chuck and having a bit head extending below said chuck, said bit head having at least one substantially longitudinal air channel defined down the outside of the bit and extending through the cutting face thereof:

a gauge sleeve secured in relation to said chuck; and at least one air passage defined between said gauge sleeve and said chuck having a terminal portion extending substantially parallel to the axis of the drill bit and substantially in register with said air channel;

wherein air flow from said air passage is substantially parallel to the drill axis and said air flow is released a distance from said cutting face.

2. Drilling apparatus according to claim 1, wherein said drilling apparatus is selected from reverse circulation drilling apparatus.

3. Drilling apparatus according to claim 2, wherein said drilling apparatus is selected from tricone reverse circulation apparatus and down-the-hole hammer apparatus.

4. Drilling apparatus according to claim 3, wherein said down-the-hole hammer apparatus is a face sampling down-the-hole hammer.

5. Drilling apparatus according to claim 4, wherein said chuck comprises a drive sub threadably engaged with a hammer casing.

6. Drilling apparatus according to claim 5, wherein said drill bit comprises a splined shank portion which is adapted to mounted in axial sliding relation to a correspondingly splined portion of the drive sub.

7. Drilling apparatus according to claim 1, wherein said gauge sleeve is secured to said chuck or said casing by threads.

8. Drilling apparatus according to claim 1, wherein said gauge sleeve has an annular flange adapted to be secured by the engagement of said chuck with said casing.

9. Drilling apparatus according to claim 8, wherein said gauge sleeve is located against rotation relative to the chuck or hammer casing by the provision of keys or pins associated with the annular flange.

10. Drilling apparatus according to claim 1, wherein said at least one air passage comprises an annular space.

11. Drilling apparatus according to claim 10, wherein said terminal portion comprises a relatively narrow annular space opening toward the bit head.

12. Drilling apparatus according to claim 1, wherein said at least one air passage comprises at least one conduit formed in one or both of the gauge sleeve and the chuck.

13. Drilling apparatus according to claim 12, wherein said terminal portion comprises a terminal portion of said at least one conduit opening toward the bit head.

14. Drilling apparatus according to claim 1, wherein said air passage is supplied with flushing air from a source selected from the air supply side or exhaust air from a free piston hammer.

15. Drilling apparatus according to claim 14, wherein there is provided a plurality of said air passages, each supplied with exhaust air from said free piston hammer.

16. Drilling apparatus according to claim 15, wherein said air passages form corresponding conduits from passages venting said exhaust air and provided in a spline engagement between said chuck and said bit.

17. Drilling apparatus according to claim 16, wherein ports through the chuck provide communication between each said spline and its corresponding air passage.

18. Drilling apparatus according to claim 16, wherein local air pressure and velocity variations at the splines is alleviated by manifolding said exhaust air in the region of the splines, and wherein ports convey the air from the manifold to the air passages.

19. Drilling apparatus according to claim 1, wherein said terminal portions exit the assembly of the chuck and gauge sleeve at coterminous lower ends thereof.

20. Drilling apparatus according to claim 1, wherein said gauge sleeve extends beyond the lower end of the drive sub to cover part of the bit head, whereby the gauge sleeve shrouds a portion of the bit head channels below the air passages thereby further constraining the flow of air towards the cutting face of the bit.

21. Drilling apparatus according to claim 1, wherein said channels in the side of the bit head remain substantially parallel to the axis of the drill assembly through to the cutting face of the bit.

22. Drilling apparatus according to claim 21, wherein said channels are partially or fully closed to the sides.

23. Drilling apparatus according to claim 21, wherein the cross sectional area of each of said channels is at least as large as the cross sectional area of the respective terminal portion.

24. Drilling apparatus according to claim 21, wherein said channels include channels of section selected to provide direct flushing air preferentially to the face of the bit adjacent to said channels extending through the cutting face of said bit head, and further includes other channels adapted to provide flushing air preferentially and tangentially across the central portion of the cutting face of the bit.

* * * * *

UNITED STATES PATENT AND TRADEMARK OFFICE

CERTIFICATE OF CORRECTION

PATENT NO. : 6,702,045 B1
DATED : March 9, 2004
INVENTOR(S) : John Elsby

It is certified that error appears in the above-identified patent and that said Letters Patent is hereby corrected as shown below:

Title page,
Item [73], Assignee, should read

-- [73] Assignee: Azuko Pty Ltd, Kewdale (AU) --

Signed and Sealed this

Twenty-eighth Day of September, 2004

JON W. DUDAS
*Director of the United States Patent and Trademark Office*